US005720052A

United States Patent [19]

Walker

[11] Patent Number: 5,720,052

[45] Date of Patent: Feb. 24, 1998

[54] NECK PROTECTION DEVICE

[76] Inventor: Fern Lisa Walker, 7636 NW. 25th St., Margate, Fla. 33063

[21] Appl. No.: 521,537

[22] Filed: Aug. 30, 1995

[51] Int. Cl.[6] ..... A61F 9/00

[52] U.S. Cl. ..... 2/468; 2/9; 2/206; 2/916; 128/857; 128/863; 128/206.19; 128/206.25

[58] Field of Search ..... 2/1, 455, 2.14, 2/410, 424, 15, 12, 427, 452, 453, 454, 9, 468, 206, 202, 91, 171, 916; 128/206.17, 206.16, 206.19, 202.19, 202.29, 206.12, 206.13, 205.28, 205.29, 206.21, 206.25, 206.26, 206.27, 206.28, 201.29, 863, 857, 201.13, 206.22, DIG. 24, 201.17

[56] References Cited

U.S. PATENT DOCUMENTS

| | | | |
|---|---|---|---|
| D. 347,090 | 5/1994 | Brunson | D29/8 |
| 766,963 | 8/1904 | Murray | 2/91 |
| 2,515,009 | 7/1950 | Hyghlago | 128/206.19 |
| 2,818,857 | 1/1958 | Wilkins et al. . | |
| 3,823,418 | 7/1974 | Piper | 2/206 |
| 3,878,563 | 4/1975 | Pulju | 2/9 |
| 3,885,558 | 5/1975 | Belkin | 128/142.7 |
| 4,168,543 | 9/1979 | Baker | 2/91 |
| 4,495,660 | 1/1985 | Hayden | 2/91 |
| 4,718,123 | 1/1988 | Petropoulos | 2/91 |
| 4,780,912 | 11/1988 | Harmsen | 2/91 |
| 4,825,878 | 5/1989 | Kuntz et al. | 128/857 |
| 4,884,296 | 12/1989 | Nix, Jr. | 2/11 |
| 4,966,140 | 10/1990 | Herzberg | 2/9 |
| 4,975,982 | 12/1990 | Hughes | 2/49 R |
| 5,097,534 | 3/1992 | Viemeister et al. | 2/114 X |
| 5,099,525 | 3/1992 | Mileauro | 2/9 |
| 5,115,516 | 5/1992 | Golde | 2/108 |
| 5,212,837 | 5/1993 | Gose et al. | 2/916 |
| 5,322,061 | 6/1994 | Brunson | 128/206.13 |
| 5,596,985 | 1/1997 | Collier | 2/9 |

FOREIGN PATENT DOCUMENTS

| | | |
|---|---|---|
| 0 316 291 | 5/1989 | European Pat. Off. . |
| WO 94/19976 | 9/1994 | WIPO . |
| PCT/US 96/13950 | 11/1996 | WIPO . |

OTHER PUBLICATIONS

Kimberly–Clark, 1994–1995 Infection Control Products Catalog, 1994, "Protective Surgical Hood—Tie Neck",p. 3.

Kimberly–Clark, 1994–1995 Infection Control Products Catalog, 1994, "Full–Coverage Protective Surgical Hood", p. 3.

Advertising Flyer: Splash Shield Face Protection System, No Date, "Para Shield," 2 pages.

General Medical Corporation, Reference Catalog of Equipment and Supplies for Hospitals, year unknown, "Kimberly–Clark Surgical Cap, Hood".

*Primary Examiner*—Jeanette E. Chapman

*Attorney, Agent, or Firm*—Finnegan, Henderson, Farabow, Garrett & Dunner, L.L.P.

[57] ABSTRACT

A disposable neck protection device that not only covers the neck region, but is comprised of a material which prevents particles from penetrating it while at the same time, allowing the wearer's skin to breathe. The device covers the cheeks and other areas below the level of the wearer's eyes. The device attaches to the front of a mask via sticky tabs or Velcro, having its main portion draping down the front of the neck just below the clavicles, its lower portion fastening behind the wearer's neck via fasteners such as ties, buttons, Velcro or similar means. The neck protection device can be manufactured to accommodate any standard or custom size. The device is made of an absorbent outer layer and an impermeable inner layer which prevents debris from contacting the user's skin yet allows for air flow. The lower end of the device can fit under a gown whereas at the top, it attaches directly to the mask.

20 Claims, 9 Drawing Sheets

NECK PROTECTION DEVICE

BACKGROUND OF THE INVENTION

This invention relates to a device for covering the user's neck and lower facial area from the anterior portion to the nose. More particularly, the invention relates to a disposable device which attaches to a separate mask by way of sticky tabs (or any other type of fastening device such as Velcro). The device drapes down the front of the neck, dropping just below the clavicles and fastens on the back of the neck via fasteners such as ties, buttons, or Velcro or fastens around the wearer's ears via loopholes, similar to conventional eye glasses. Furthermore, the device attaches to both the bottom and sides of the mask and extends laterally to cover the wearer's face below the bridge of the nose. To perform its intended function, the device is constructed such that it allows the wearer's skin to breathe while at the same time prevents any external contaminant from coming into contact with the wearer's skin. The device may be comprised of a multi-layer material, protecting the wearer's skin from contact with airborne contaminants while at the same time preventing the airborne contaminants from escaping the surface of the device.

Presently, there are numerous protective neck garments available, most of which serve as protection from cold weather or fast blowing wind. One of the most common of such coverings is a dickey. However, it is not practical to utilize such devices to protect the wearer's neck from other outside elements, such as airborne chemicals and liquids, blood, bloodborne pathogens and other bodily fluids.

In the past, healthcare professionals were concerned about preventing the spread of infection to patients. With each human shedding up to 10,000 bacteria per minute, the presence of surgical staff posed a significant threat to patients. However, new concern for the possibility of patients infecting healthcare staff has been reinforced by the increasing exposure to bloodborne pathogens and other bodily fluids. The possibility of infection by the Human Immunodeficiency Virus (HIV) or Hepatitis B Virus (HBV) or other bloodborne pathogens is increasing nationwide. Recent studies have indicated that "strike through" blood even in small amounts can contain enough HIV to infect a healthcare worker if the skin is compromised by cuts, abrasions, or dermatitis. Therefore, it is important that workers in the health care industry, among others, be sufficiently protected. Not only must the hospital give the highest level of care to its patients, they are required to protect all healthcare workers. The Occupational Safety and Health Administration (OSHA) requires hospitals and healthcare organizations to provide "appropriate" protective equipment to any workers who are at risk of occupational exposure to blood or other potentially infectious bodily fluids. Personal protective equipment is considered to be "appropriate" only if it does not permit blood or other potentially infectious materials to pass through to or reach the employee's work clothes, street clothes, undergarments, skin, eyes, mouth, or other mucous membranes under normal conditions of use and for the duration of time which the protective equipment will be used. Nearly all existing gowns and masks leave the neck area uncovered, therefore leaving the neck area susceptible to exposure to bloodborne pathogens, bodily fluids, irrigation fluids and other abrasive chemicals, such as paint.

Numerous protective neck garment designs are known in the art. For example, U.S. Pat. No. 4,168,543 to Baker discloses a protective neck garment for use in cold weather.

The garment consists of a one-piece tubular body having outwardly flared ends which rest on the wearer's shoulders. Inverted v-shaped slots provide openings for the wearer's shoulders. The device is a one piece, continuous, resiliently stretchable structure made of wool, generally tubular in shape, adapted to slip over the wearer's head. However, the permeable material coupled with the tubular shape requiring the wearer to slip the device over his head makes the device inadequate for use in protecting against airborne particles, especially in the operating room.

The protective neck covering in U.S. Pat. No. 4,495,660 to Hayden discloses a neck garment to be worn with an outer garment, such as a coat or a sweater. The garment has both a portion for tucking beneath the shoulder portions of an outer garment and a portion which can be rolled, covering just the neck area, or which can be unrolled to cover not only the neck but portions of the face as well. End-to-end fastening means are provided which permit putting the garment on without pulling the garment over the wearer's head. However, the device does not permit its wearer's skin to "breathe" and its use would not prevent exterior particles from coming into contact with the wearer's neck area.

U.S. Pat. No. 4,718,123 to Petropoulos discloses a cold climate protective garment. The garment is made of a woven fabric, completely homogeneous in construction, including a main body portion of the same general shape as that of the upper torso in that the bottom is narrower than the top. At the top of the garment are two directly opposed straight appendages that emanate from the main body at ninety degree angles. These apertures wrap around a user's neck and fasten to one another at the ends. At the top of the appendages and centered with the main body is an additional portion of fabric, semi-elliptical in shape. This design would not be practical for use in preventing airborne particles from coming into contact with the wearer's skin. Additionally, its heavy construction and heat-retaining characteristics are detrimental to the wearer when performing tasks such as applying chemicals or operating on a patient.

Gowns exist which integrally incorporate a neck or collar extension. However, because the collar portion completely encircles the wearer's neck, little or no air is allowed to circulate about the wearer's neck, causing discomfort. In addition, the collar portion is not removable, forcing its wearer to choose the collar-integrated design option prior to actual commencement of the task. The integral nature of the design precludes the wearer from removing the collar during use, as any attempt to remove the gown from the wearer would compromise the integrity of the sterile field (if applicable). Furthermore, healthcare providers who become contaminated cannot wash off the area immediately after exposure without violating the sterile field required in all surgical procedures. This also includes members of the surgical team as well as other personnel who also risk contamination from the patient.

Surgical cap/hood combination garments are known. For example, the Kimberly-Clark® Surgical Cap, Hood discloses a cap-hood combination whereby the wearer's entire head is covered as well as his neck region. However, this design suffers from several disadvantages. The hooded construction covers the wearer's ears, hindering the wearer's hearing, which at times may be critical, especially during surgery. The hooded design also restricts vertical and lateral movement of the wearer's head and limits the wearer's field of peripheral vision. Furthermore, with this type of configuration, the neck area can become hot and uncomfortable with perspiration due to its one-piece construction. Lastly, should neck protection previously unforeseen become necessary during a procedure, the hood design cannot be utilized without compromising the integrity of the sterile field.

The foregoing demonstrates a need for a protection device which covers the wearer's neck that is constructed so that it not only allows the wearer's neck to "breath," but also prevents outside particles from coming into contact with the wearer's skin. A separate neck cover is needed for the existing gown and mask designs prevalent today. More particularly, what is needed is a protective neck cover which can easily be attached to existing gown and mask designs, making it unnecessary to replace existing supplies of gowns or masks or change existing suppliers of preferred gown designs.

SUMMARY OF THE INVENTION

Accordingly, it is an object of the present invention to overcome the deficiencies noted above.

The neck protection device of the invention meets these needs and overcomes the disadvantages and drawbacks of the prior art by providing a disposable neck protection device that not only covers the neck region, but is comprised of a material which prevents particles from penetrating it while at the same time trapping those particles, preventing their re-entry into the air. The device covers the cheeks and other areas below the level of the wearer's eyes. In one embodiment, the device attaches to the front of a mask via sticky tabs or Velcro, having its main portion draping down the front of the neck just below the clavides, its lower portion fastening behind the wearer's neck via fasteners such as ties, buttons, Velcro or similar means. The neck protection device can be manufactured to accommodate any standard or custom size. The simplicity of design allows for standard manufacturing processes which minimizes production costs, in turn reducing retail cost. The device is made of an absorbent outer layer and an impermeable inner layer which prevents debris from contacting the user's skin yet prevents the debris from re-entering the atmosphere. The lower end of the device fits under the surgical gown whereas at the top, it attaches directly to the mask. Accordingly, the device may be removed or attached without compromising the integrity of the sterile field. The device is donned with the mask prior to gowning and scrubbing. Because the device is not attached to a full length gown but open in back, air is allowed to circulate underneath the device enhancing the wearer's overall comfort.

The neck protection device may be constructed so that it is readily disposable after a single use. The possibility of HIV and HBV transmission has increased the need to select the gown and drape system with the most reliable performance. Because they provide protection and repellency, single-use products are often the choice of healthcare professionals. When modification is required, the wearer can easily adjust the device neck protection device to a specific need or procedure, without future economic penalty. Additionally, many special features are available with single-use products, including elastic fenestration, impervious reinforcements and adhesive strips. Conversely, when a reusable product is modified for a specific surgery or use, its further use is ended and any additional lifespan is lost.

Single-use gowns, made from nonwoven fabrics ("nonwovens"), offer high performance at low cost. Nonwovens are fabrics engineered to provide specific characteristics. They are used in many medical procedures, providing material for filters in heart/lung machines, blood oxygenators, kidney dialysis units and single-use gowns and drapes. In the non-medical world, nonwovens are used in a wide variety of products, including clothing, home furnishings, sporting goods and construction materials. For many years, gowns made from woven, 140-count cotton muslin were the standard. Liquid strike-through and skin cell fragments, which range from 5 to 60 micrometers, could easily penetrate the threads of 140-count muslin, allowing contaminants to reach the wearer's skin. Tighter weaves, fluid-repellent finishes and new types of fabrics (100% polyester fiber) have been developed to improve the barrier properties of the woven material. The latest development in the reusable fabric area is layered fabric, which places an impervious membrane between two layers of fabric. This type of material not only allows the wearer's skin to breathe, but also prevents blood or other contaminants from dripping from the neck protection device onto to sterile field or other protected area. A preferred embodiment may be constructed of a material having two layers, one permeable layer and one impermeable layer. The permeable layer prevents the fluid from dripping back onto the sterile field, whereas the impermeable layer prevents the fluid from making contact with the wearer's skin.

All procedures do not require the same type of protective equipment. The type of clothing and its level of protection will depend on the procedure and the degree of exposure anticipated. Face masks and eye protection are generally worn when there is a risk of splashes, spray or splatter of blood, infectious material or chemicals coming in contact with the neck and facial area. While some types of materials may provide adequate protection for a few minutes, other types may be required to endure exposure for extended periods of time. The conditions may also indicate the kind of equipment to be used. For example, a face mask may be necessary in a situation where blood or paint is likely to spray or splatter. To accommodate these varying situations, the present invention is removably attached to a face mask. Gowns are only considered sterile from operative area up to within one to two inches of the neckline, and around the sleeves, in other words, the areas you can see yourself. The neck area is not considered a sterile area in the medical industry. Therefore, should the situation develop into one in which splattering occurs, the wearer may easily affix the device to the mask by way of Velcro or sticky tabs without compromising the sterile field. Conversely, if the procedure becomes one in which neck protection is no longer necessary, the device neck protection device may be easily removed from the mask without compromising the integrity of the sterile field. Hooded designs do not offer this luxury because they may not be removed without compromising the integrity of the sterile field.

Although protection for the wearer (and patient if applicable) is the primary variable when choosing a protective garment, comfort and convenience are also important factors. The conditions under which a task is performed can be less than favorable, and long procedures make comfort even more critical. For example, standard operating conditions in an operating room include an air temperature of 68–76 degrees F. and 50–60 percent relative humidity. However, overhead lights cause an increase in the operative temperature. With several layers of clothing, surgical personnel may feel uncomfortably hot. The resulting heat stress, added to the length and difficulty of the operation, may impair the performance of the surgical team. Similarly, individuals working with chemicals and other toxic compounds often perform their tasks in less than ideal temperatures. For example, when painting an automobile, the temperatures must necessarily be warm to facilitate drying of the applied paint. The most comfortable gowns and other garments are those that allow air to pass through the fabric. "Breathability" is measured by testing the amount of air that can pass through a square foot of fabric in a given time and at a given pressure gradient. While liquidproof protective garments provide necessary protection, they allow minimal air permeability. Constructing the invention to provide for air flow from behind the wearer's neck in combination with a bi-layer material fabrication greatly enhances the wearer's comfort.

DETAILED DESCRIPTION

The invention is described and illustrated below in the context of an attachment to a surgical mask, although the invention may be attached to any similar mask or directly to the wearer for any similar purpose, in which the wearer seeks protection from skin contact with external particles. Although the disclosure hereof is detailed and exact to enable those skilled in the art to practice the invention, the physical embodiment herein disclosed merely exemplifies the invention, which may be embodied in other specific structure. The scope of the invention is defined in the claims appended hereto.

Referring to FIGS. 1 to 17 of the attached drawings, preferred embodiments of the present invention will now be described.

Figure 1:
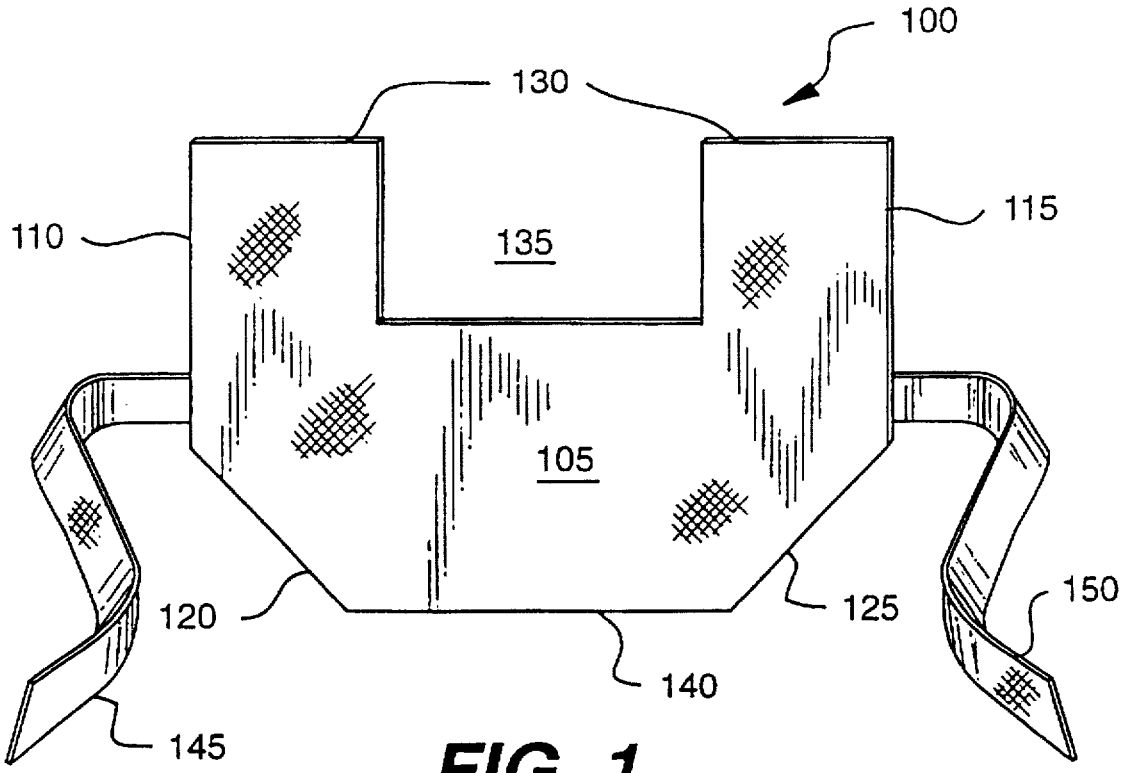
FIG. 1 is a front view of the invention.
Figure 2:
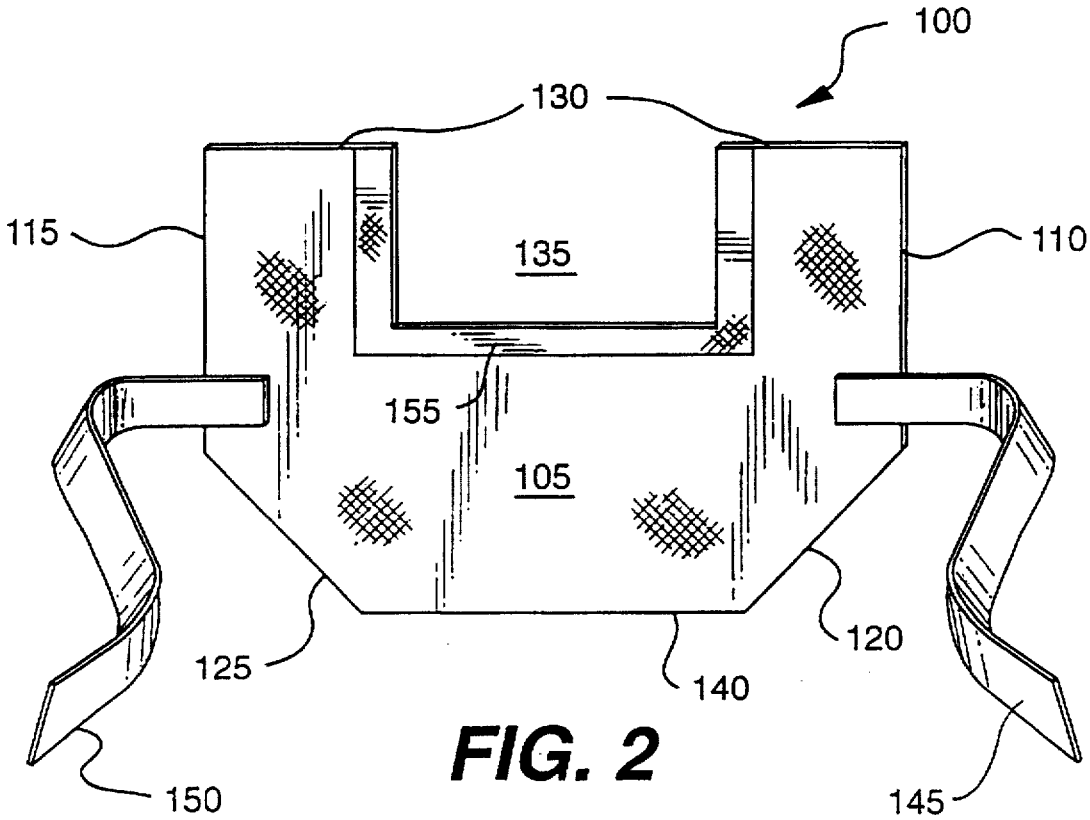
FIG. 2 is a rear view of the invention.
Figure 3:
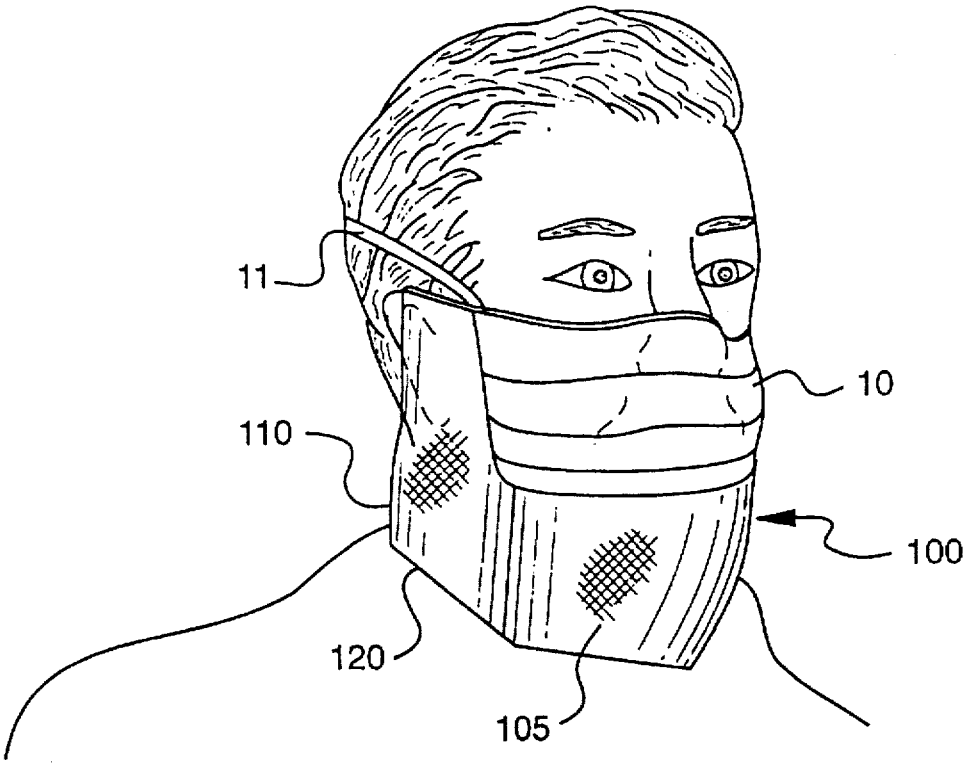
FIG. 3 is a perspective view of the invention in use.
Figure 4:
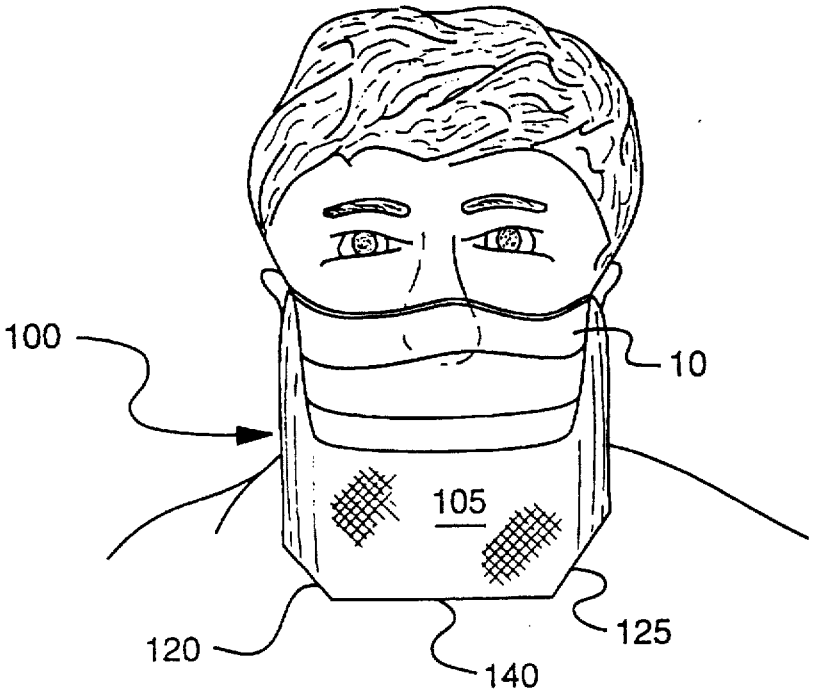
FIG. 4 is a front view of the invention in use.

As shown in FIGS. 1 through 5, the neck protection device 100 may have a semi-octagonal drape portion 105. The drape portion 105 may also encompass a semi-circular shape, a semi-elliptical shape or any other suitable shape which will cover the wearer's neck region. The drape portion 105 is defined by first and second side edges 110, 115, first and second angled edges 120, 125, an upper horizontal edge 130, a mask receiving portion 135 and a lower horizontal edge 140. As shown in FIG. 1, the first and second side edges 110, 115 are approximately equal in length. The first and second angled edges 120, 125 are approximately equal in length, lying between said first and second side edges 110, 115 and said lower horizontal edge 140. The first and second side edges 110, 115, first and second angled edges 120, 125, lower horizontal edge 140, upper horizontal edge 130 and the mask receiving portion 135 all reside in the same plane. The neck protection device 100 has first and second neck fastening means 145, 150 attached to the drape portion 105 in close proximity to the first and second side edges 110, 115. As best seen in FIG. 2, the first and second neck fastening means 145, 150 are attached to the rear surface of the neck protection device 100, in close proximity to the first and second side edges 110, 115, by conventional stitching, sticky tape, Velcro or any other suitable fastening means or may be integral with the material forming the drape portion 105 of the neck protection device 100. The mask receiving portion 135, generally rectangular in shape, is essentially a cut-out portion along the center aspects of the upper horizontal edge 130. The mask receiving portion 135 extends from the upper horizontal edge 130 and terminates before the intersection between the first and second side edges 110, 115 and the first and second angled edges 120, 125. Along the periphery of the mask receiving portion 135 is the mask fastening means 155 which may comprise "sticky tabs," Velcro or any other suitable fastening means. The mask fastening means 155 need not be continuous around the periphery of the mask receiving portion 135.

Figure 5:
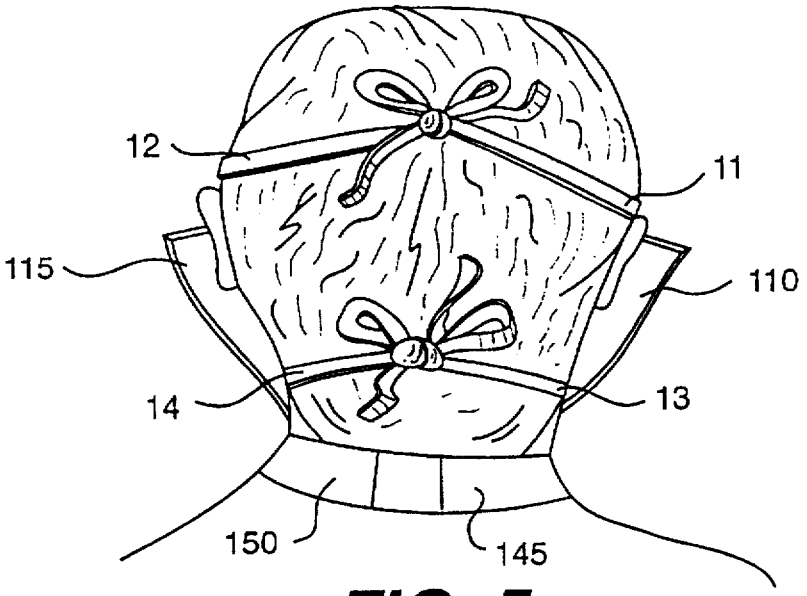
FIG. 5 is a rear view of the invention in use.

In use, a mask is first donned by the wearer. The mask 10 includes first and second cranium fastening straps 11, 12 and first and second jaw straps 13, 14 for affixing the mask to the wearer's nose and mouth region. The neck protection device 100 is then attached to the mask 10, wherein the mask fastening means 155 around the mask receiving portion 135 engage the outer edges of the mask 10. The neck protection device 100 is attached such that the majority of the mask 10 remains uncovered by the neck protection device 100. The first and second neck fastening means 145, 150 are brought around the side of the wearer's head and secured behind the wearer's head at or preferably below the wearer's ears (as best shown in FIG. 5). The first and second neck fastening means 145, 150 may also terminate to form loops which encircle the wearer's ears, much like conventional eye wear. The lower horizontal edge 140 tucks under a surgical gown or other garment (if applicable). Should the procedure be such that neck protection is no longer necessary, the neck protection device 100 may be removed by simply disengaging the first and second neck fastening means 145, 150 and disengaging the mask fastening means 155 from the mask 10. A two-piece construction consisting of separate face/mouth mask and neck device allows additional air circulation. Because the invention does not completely encircle the wearer's neck, air is allowed to flow from behind the wearer's neck, lowering the temperature under the neck covering. Additionally, a separate neck cover gives the wearer the option of wearing neck protection. Choosing neck protection may be determined, for example, by assessing the risk of blood projection emanating from the patient's wound, taking into consideration the specific surgical procedure being performed.

Figure 6:
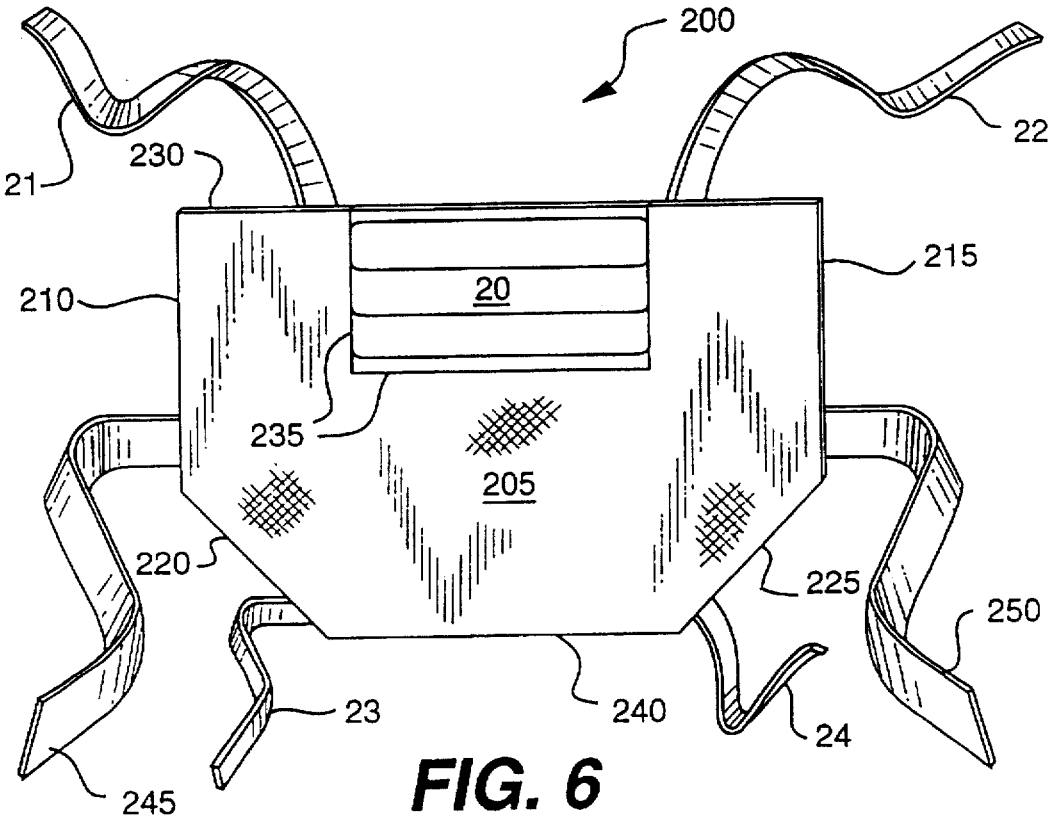
FIG. 6 is a front view of a second embodiment of the invention.
Figure 7:
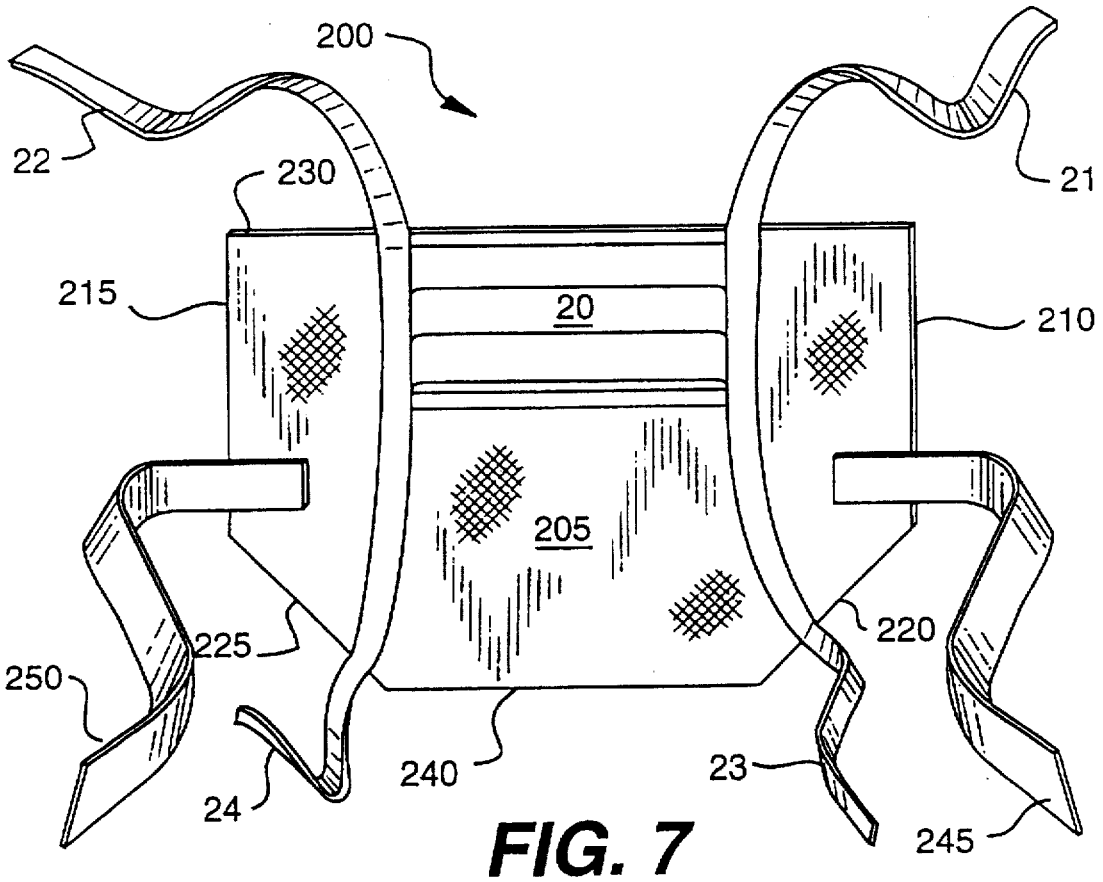
FIG. 7 is a rear view of a second embodiment of the invention.

A second embodiment 200 is illustrated in FIGS. 6 and 7. In this embodiment, the neck protection device 200 includes a mask 20 which is permanently affixed to the drape portion 205 at the mask receiving portion 235. First and second cranium fastening straps 21, 22 emanate from the neck protection device 200 near the upper corners of the mask 20. At the lower corners of the mask 20 are first and second jaw straps 23, 24. Similar to the first embodiment, the neck protection device 200 may have a semi-octagonal drape portion 205. The drape portion 205 may also encompass a semi-circular shape, a semi-elliptical shape or any other suitable shape which will cover the wearer's neck region. The drape portion 205 is defined by first and second side edges 210, 215, first and second angled edges 220, 225, an upper horizontal edge 230, a mask receiving portion 235 and a lower horizontal edge 240. The neck protection device 200 has first and second neck fastening means 245, 250 attached to the drape portion 205 in close proximity to the first and second side edges 210, 215.

Because a mask 20 is integrated with the neck protection device 200, a mask 20 need not be donned by the user prior to use. In use, the first and second cranium fastening straps 21, 22 are pulled behind the wearer's head above the ears and releasably secured behind the wearer's head. Then the first and second jaw straps 23, 24 are pulled behind the wearer's neck area and releasably secured below the wearer's ears. Finally, the first and second neck fastening means 245, 250 are secured behind the wearer's neck, completely enclosing the neck region from foreign contaminants. The lower horizontal edge 240 is tucked underneath a surgical gown or other garment (if applicable).

Figure 8:
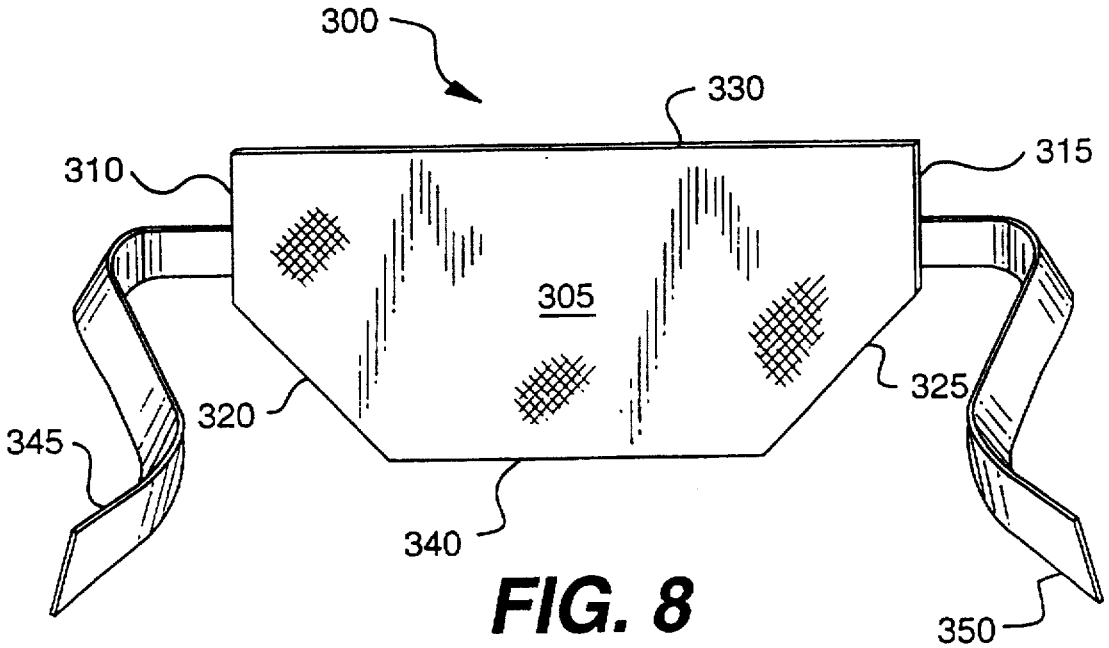
FIG. 8 is a front view of a third embodiment of the invention.
Figure 9:
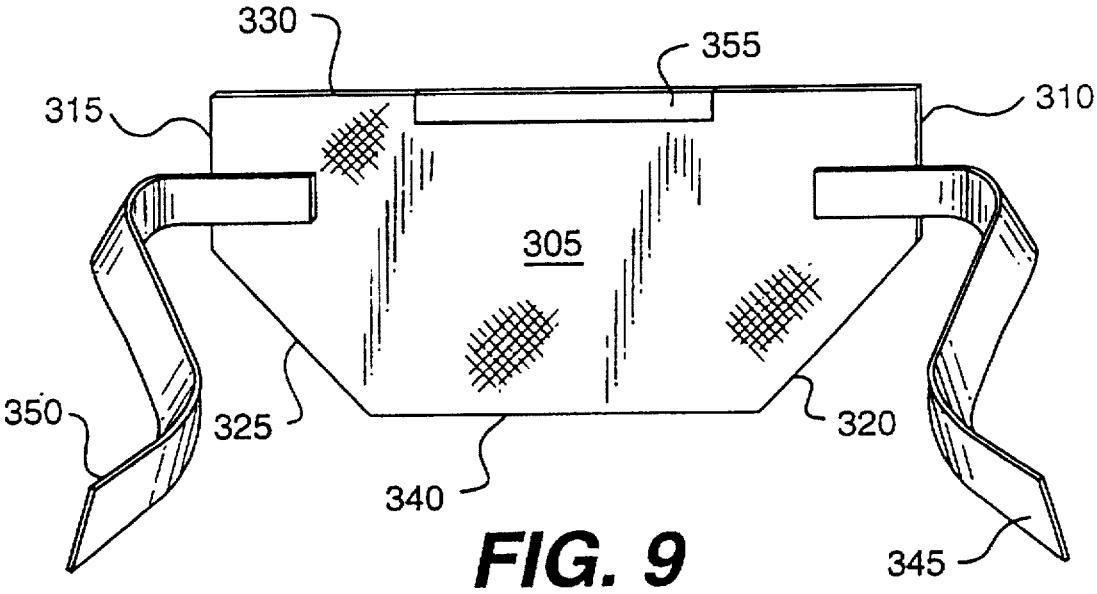
FIG. 9 is a rear view of a third embodiment of the invention.

A third embodiment 300, as shown in FIGS. 8 through 12, illustrates a neck protection device 300 without a mask receiving portion 135, 235 as defined by the first two embodiments 100, 200. The drape portion 305 is semi-octagonal in shape, but may encompass any shape suitable for protecting the neck region from exposure to foreign contaminants. The circumference of the drape portion 305 comprises first and second side edges 310, 315, first and second angled edges 320, 325, an upper horizontal edge 330 and a lower horizontal edge 340. As best illustrated in FIG. 8, in close proximity to the first and second side edges 310, 315 are first and second neck fastening means 345, 350. As best illustrated in FIG. 9, a lower mask fastening means 355 resides at the upper horizontal portion 330 of the neck protection device 300.

Figure 10:
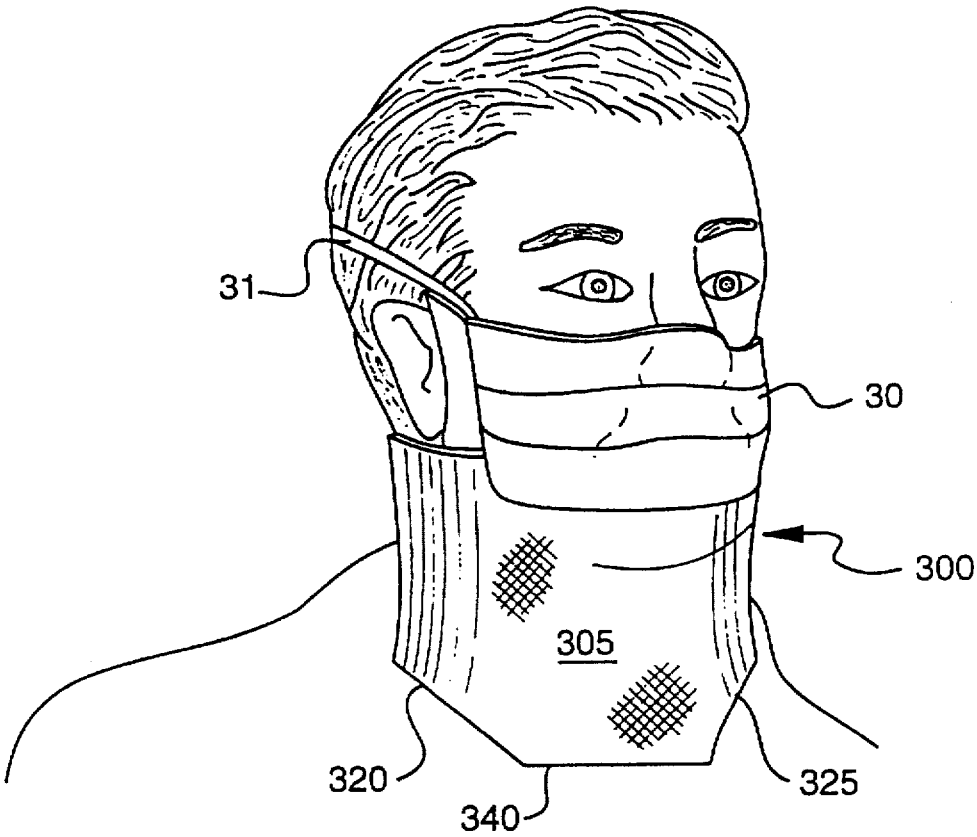
FIG. 10 is a perspective view of a third embodiment of the invention in use.
Figure 11:
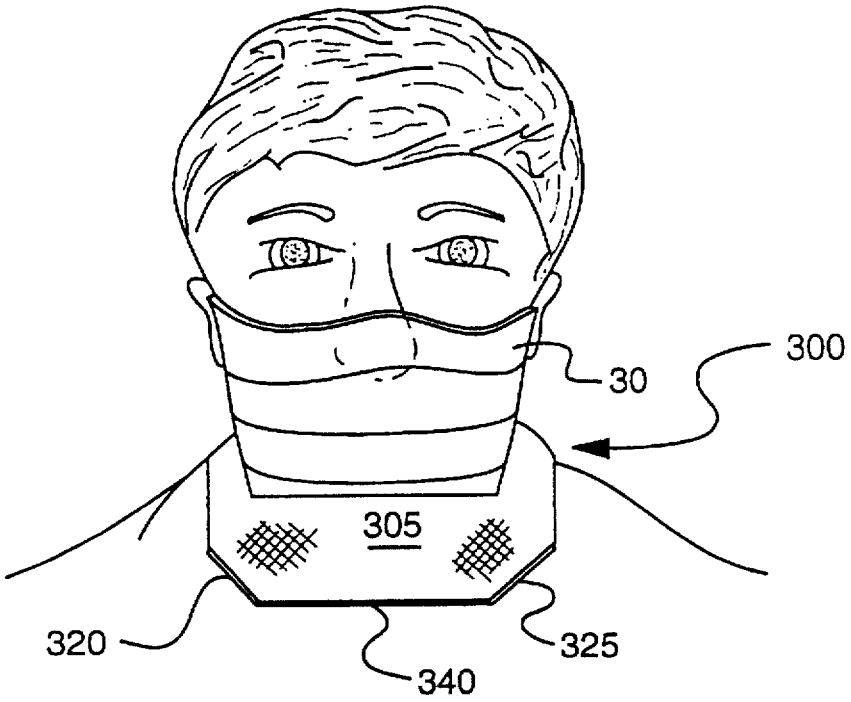
FIG. 11 is a front view of a third embodiment of the invention in use.
Figure 12:
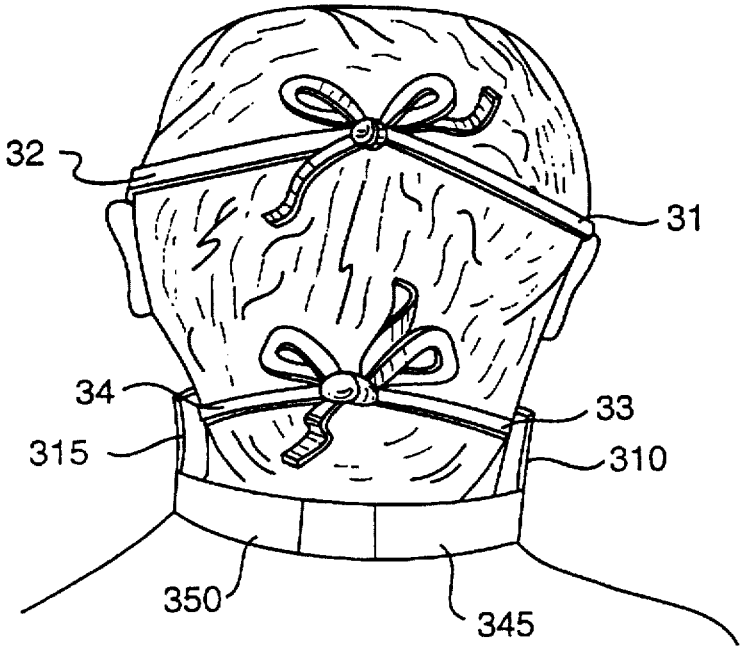
FIG. 12 is a rear view of a third embodiment of the invention in use.
Figure 13:
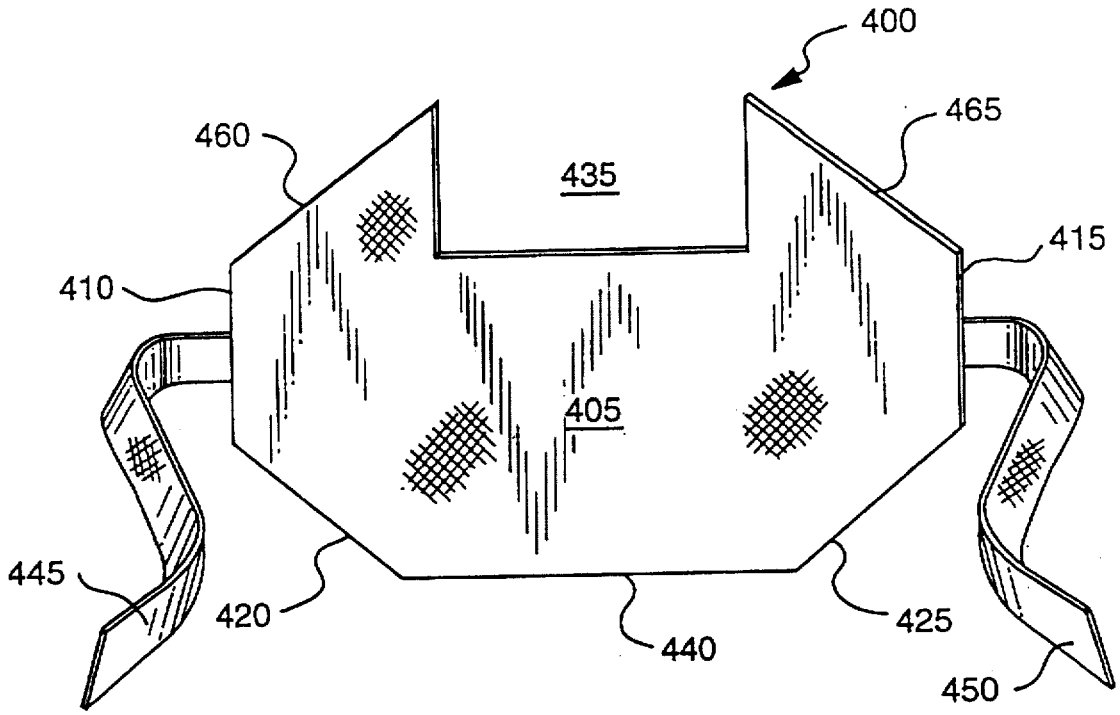
FIG. 13 is a front view of a fourth embodiment of the invention.

As with the first embodiment 100, a mask 30 must be worn prior to utilizing the neck protection device 300. The mask 30 is donned by fastening first and second cranium fastening straps 31, 32 behind the wearer's head above the ears. Then, first and second jaw straps 33, 34 are pulled behind the wearer's neck area and releasably secured below the wearer's ears. Once the mask 30 is secured to the wearer's face, the lower mask fastening means 355 is attached to the lower aspects of the mask 30 (as best shown in FIGS. 10 and 11). The first and second neck fastening means 345, 350 are then secured behind the wearer's head. The lower horizontal edge 340 is then tucked beneath the surgical gown or other garment (if applicable), completing the protection system.

Figure 14:
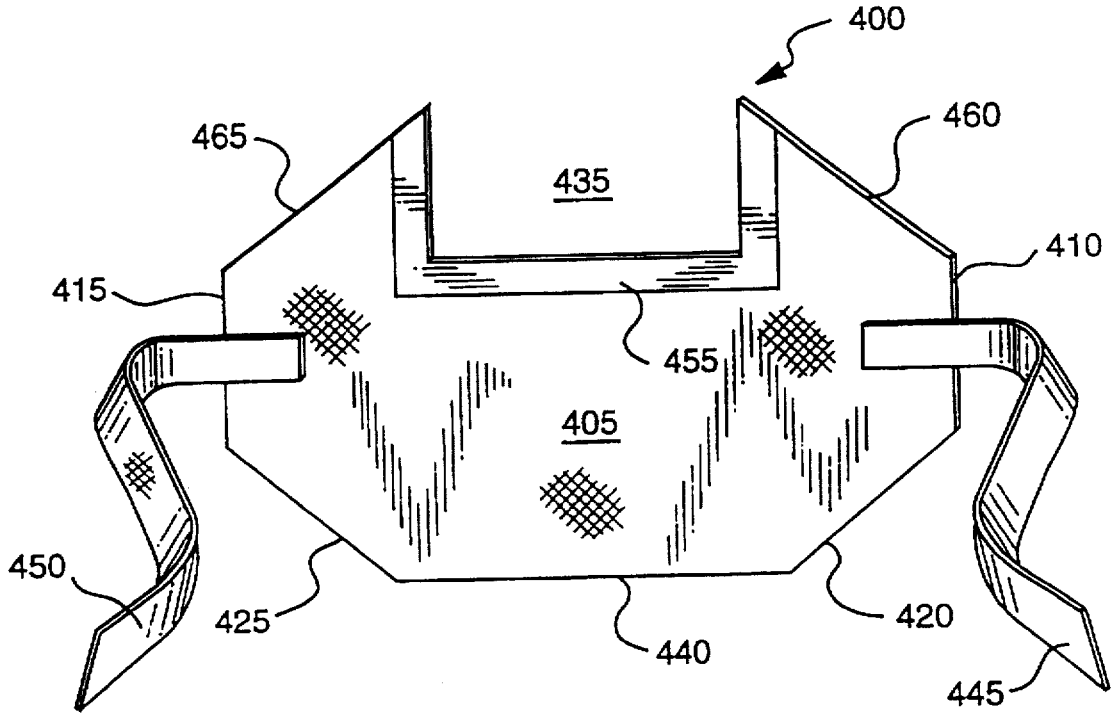
FIG. 14 is a rear view of a fourth embodiment of the invention.
Figure 15:
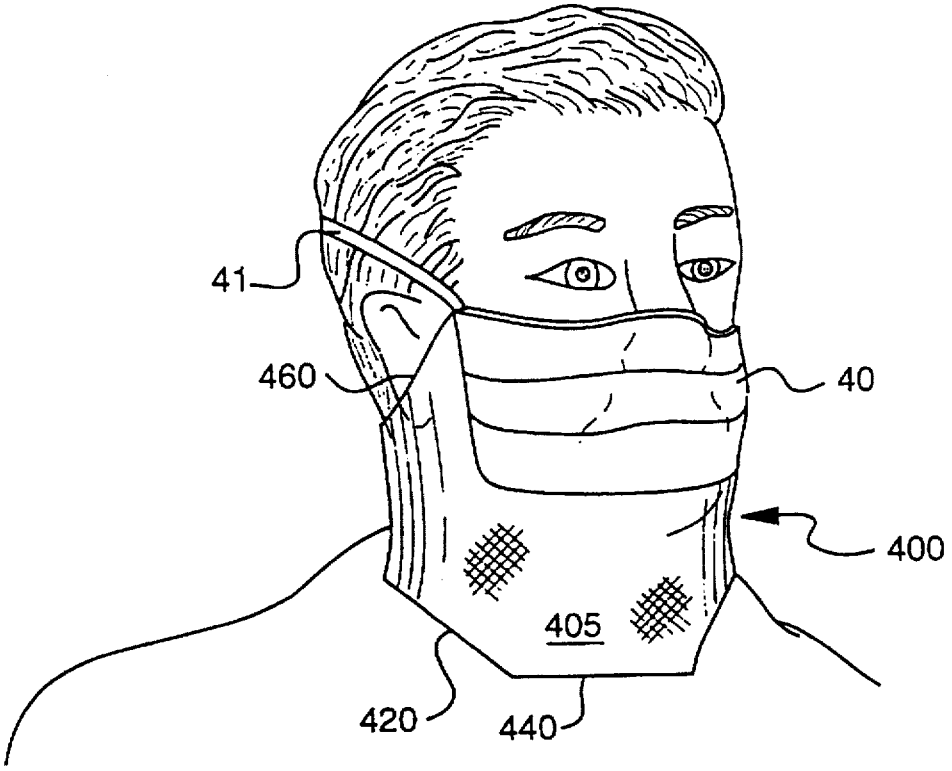
FIG. 15 is a perspective view of a fourth embodiment of the invention use.
Figure 16:
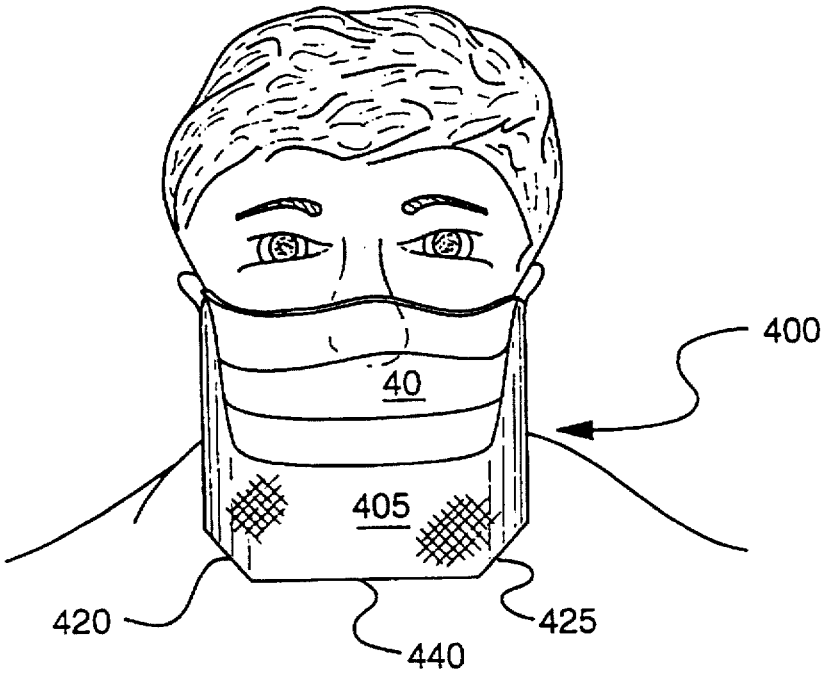
FIG. 16 is a front view of a fourth embodiment of the invention in use.

A fourth embodiment 400 is illustrated in FIGS. 13 through 17. The device of this embodiment encompasses the same features as the first embodiment 100, the exception being the alteration of the first and second side edges 110, 115. As shown in FIGS. 13 through 17, the neck protection device 400 includes a semi-octagonal drape portion 405. The drape portion 405 may also take the form of a semi-circular shape, a semi-elliptical shape or any other suitable shape which will effectively cover the wearer's neck region. The drape portion 405 is defined by first and second side edges 410, 415, first and second angled edges 420, 425, third and fourth angled edges 460, 465, a mask receiving portion 435 and a lower horizontal edge 440. The neck protection device 400 has first and second neck fastening means 445, 450 attached to the drape portion 405 in close proximity to the first and second side edges 410, 415. As best seen in FIG. 14, the first and second neck fastening means 445, 450 are attached to the rear surface of the neck protection device 400 by conventional stitching, sticky tape, Velcro or any other suitable fastening means or may be integral with the material forming the drape portion 405 of the neck protection device 400. The mask receiving portion 435, generally rectangular in shape, is essentially a cutout portion. Along the periphery of the mask receiving portion 435 is the mask fastening means 455 which may comprise "sticky tabs," Velcro or any other suitable fastening means. The mask fastening means 455 need not be continuous around the periphery of the mask receiving portion 435.

Figure 17:
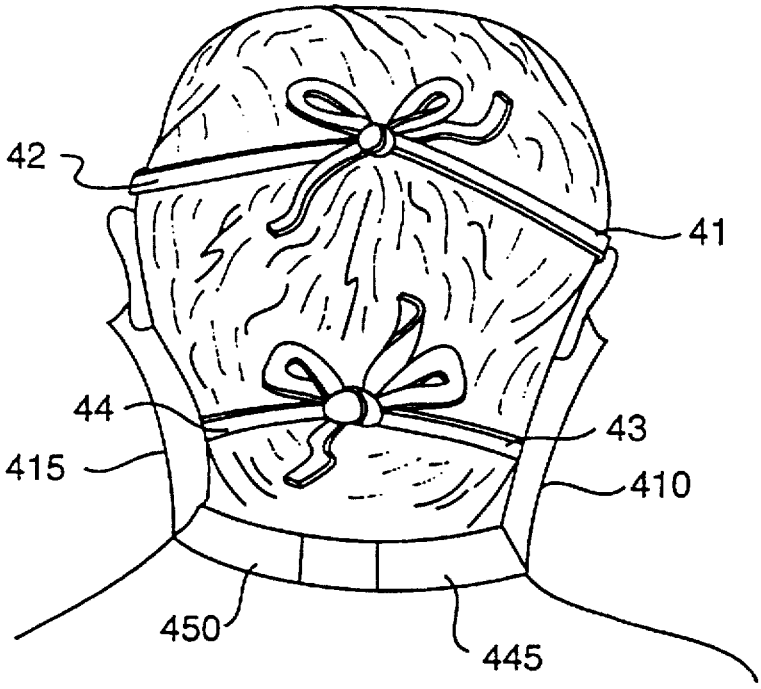
FIG. 17 is a rear view of a fourth embodiment of the invention in use.

In use, a mask 40 is first donned by the wearer. The mask 40 includes first and second cranium fastening straps 41, 42 and first and second jaw straps 43, 44 for affixing the mask around the wearer's nose and mouth region. The neck protection device 400 is then attached to the mask 40, wherein the mask fastening means 455 around the mask receiving portion 435 engage the outer edges of the mask 40. The neck protection device 400 is attached such that the majority of the mask 40 remains uncovered by the neck protection device 400. The first and second neck fastening means 445, 450 are brought around the side of the wearer's head and secured behind the wearer's head at or preferably below the wearer's ears (as best shown in FIG. 17). The first and second neck fastening means 445, 450 may also terminate to form loops which encircle the wearer's ears, much like conventional eye wear. The lower horizontal edge 440 tucks trader a surgical gown or other garment (if applicable). Should the procedure be such that neck protection is no longer necessary, the neck protection device 400 may be removed by simply disengaging the first and second neck fastening means 445, 450 and disengaging the mask fastening means 455 from the mask 40.

Thus, it is apparent that there has been provided, in accordance with the invention, a neck protection device that fully satisfies the aims and advantages set forth above. While the invention has been described in conjunction with specific embodiments thereof, it is evident that many modifications, alternatives, and variations will be apparent to those skilled in the art in light of the foregoing description. Accordingly, it is intended to embrace all such modifications, alternatives, and variations that fall within the spirit and broad scope of the appended claims.

What is claimed is:

1. A garment for attachment to a mask for protecting a user's neck from exposure to blood borne pathogens and other airborne particles, the garment comprising:

a drape portion substantially shaped to conform to the user's neck region, said drape portion having an upper edge and a substantially u-shaped mask receiving portion along said upper edge, said mask receiving portion having one of an adhesive and hooks facing toward the user releasably securing said mask receiving portion to the outer surface of the mask; and a neck fastener emanating from said drape portion for securing said drape portion to the user.

2. The garment according to claim 1 wherein said drape portion and said fasteners are non-sterile.

3. The garment according to claim 1, wherein said drape portion is detachable from said mask.

4. The garment according to claim 1, wherein said drape portion comprises a light weight fabric material which prohibits external particles from coming into contact with the user's skin.

5. The garment according to claim 4, wherein said material is formed of a first layer of a permeable light-weight fabric and a second layer of a non-permeable light-weight fabric.

6. The garment according to claim 1, wherein said adhesive comprises glue.

7. The garment according to claim 1, wherein said hooks comprise a hook portion of a hook and loop fastener.

8. A method for protecting the neck area of an individual from exposure to fluids and other airborne particles, the method comprising the steps of:

donning a mask;

entering a sterile environment;

releasably attaching a garment to the outer surface of said mask, said garment protecting the individual's neck from exposure to fluids and other airborne particles;

detaching said garment from said mask: and exiting the sterile environment after the detaching step.

9. The method of claim 8, wherein the releasably attaching step includes the sub-step of adhesively attaching.

10. The method of claim 8, wherein the releasably attaching step includes the sub-step of hooking said garment to said mask.

11. A method for protecting the neck area of an individual from exposure to blood, blood borne pathogens, and other bodily fluids, the method comprising the steps of:

donning a standard surgical mask;

releasably affixing a garment having a substantially u-shaped indentation to the outer surface of said mask;

releasably securing said garment to the individual;

donning a standard surgical gown; and tucking the lower aspects of said garment underneath said gown.

12. The method of claim 11, further comprising the step of entering a sterile environment after the donning step.

13. The method of claim 11, further comprising the step of detaching said garment from said mask after the securing step.

14. The method of claim 12, further comprising the step of detaching said garment from said mask after the securing step.

15. The method of claim 14 further comprising the step of exiting the sterile environment after the detaching step.

16. The method of claim 12, further comprising the step of exiting the sterile environment after the securing step.

17. A garment for attachment to a standard surgical mask for protecting a user's neck from exposure to blood, blood borne pathogens, bodily fluids, and other airborne particles, said garment comprising:

a drape portion for covering the user's neck;

a substantially u-shaped mask receiving portion releasably attached to the outer surface of the standard surgical mask by one of an adhesive and hooks facing toward the user; and a fastener for securing said drape portion to the user.

18. A surgical assembly comprising:

a mask; and a garment for attachment to the mask, said garment comprising a drape portion for covering a user's neck region, said drape portion having an upper edge and a substantially u-shaped mask receiving portion along said upper edge, said mask receiving portion having one of an adhesive and hooks facing the user releasably securing said mask receiving portion to the outer surface of the mask, and said garment having a fastener emanating from said drape portion for securing said drape portion to the user.

19. The surgical assembly according to claim 18 wherein said mask comprises a standard surgical mask.

20. A garment for attachment to a mask for protecting a user's neck from airborne particles, the garment comprising:

a drape extending from the user's face toward the user's neck region, said drape having a substantially u-shaped indentation and one of an adhesive and hooks facing toward the user releasably securing said drape to the outer surface of the mask, and a neck fastener emanating from said drape for securing said drape to the user.

* * * * *

UNITED STATES PATENT AND TRADEMARK OFFICE

CERTIFICATE OF CORRECTION

PATENT NO.: 5,720,052

DATED: February 24, 1998

INVENTOR(S): Fern Lisa WALKER

It is certified that an error appears in the above-identified patent and that said Letters Patent is hereby corrected as shown below:

Claim 8, col. 9, line 21, after "particles;" insert --securing said garment to the wearer;--.

Signed and Sealed this

Ninth Day of June, 1998

*Attest:*

*Attesting Officer*

BRUCE LEHMAN

*Commissioner of Patents and Trademarks*